US005499730A

United States Patent [19]

Harbour

[11] Patent Number: 5,499,730

[45] Date of Patent: Mar. 19, 1996

[54] PLASTIC CONTAINER HAVING REINFORCING DEPRESSIONS

[75] Inventor: Richard Harbour, Upton By Chester, Great Britain

[73] Assignee: Lever Brothers Company, New York, N.Y.

[21] Appl. No.: 233,490

[22] Filed: Apr. 26, 1994

[30] Foreign Application Priority Data

Apr. 27, 1993 [GB] United Kingdom ..... 9308650

[51] Int. Cl.[6] ..... B65D 23/00

[52] U.S. Cl. ..... 215/382; 220/675

[58] Field of Search ..... 215/1 C, 100 A, 215/382; 220/675, 672, 669

[56] References Cited

U.S. PATENT DOCUMENTS

| | | | |
|---|---|---|---|
| 2,873,875 | 2/1959 | Layton, Jr. et al. | 220/675 X |
| 3,163,347 | 12/1964 | Bixler . | |
| 3,194,474 | 7/1965 | Rumberger . | |
| 3,286,902 | 11/1966 | Hunter et al. | 220/675 X |
| 3,334,802 | 8/1967 | Gooding . | |
| 3,420,431 | 1/1969 | Donovan | 220/669 X |
| 3,455,496 | 7/1969 | Franz . | |
| 4,024,975 | 5/1977 | Uhlig | 215/1 C |
| 5,100,017 | 3/1992 | Ishinabe et al. | 220/674 X |
| 5,123,554 | 6/1992 | Arvidson et al. | 220/675 X |
| 5,299,700 | 4/1994 | Beniacar | 215/1 C X |
| 5,341,946 | 8/1994 | Vailliencourt et al. | 220/675 X |

FOREIGN PATENT DOCUMENTS

| | | |
|---|---|---|
| 0446352 | 9/1991 | European Pat. Off. . |
| 1191951 | 10/1959 | France . |
| 73893 | 9/1960 | France . |
| 1432253 | 11/1968 | Germany . |
| 2161133 | 1/1986 | United Kingdom . |

*Primary Examiner*—Allan N. Shoap
*Assistant Examiner*—Christopher J. McDonald
*Attorney, Agent, or Firm*—James J. Farrell

[57] ABSTRACT

A lightweight plastics bottle (1) having a body wall of substantially constant wall thickness and having a plurality of depressed zones (7) having a floor portion (12) spaced inwardly of and parallel to the general plane of the body wall. The depressed zones (12) are arranged in a series of horizontal rows characterised in that the body is non-cylindrical having a number of body panels and that each of said depressed zones (12) has at least one long dimension (9) lying in a direction which is not parallel to the longitudinal axis (10) of the bottle.

5 Claims, 5 Drawing Sheets

PLASTIC CONTAINER HAVING REINFORCING DEPRESSIONS

This invention relates to thin wall plastics containers such as lightweight plastics bottles having a wall thickness of between about 0.2 mm and 0.6 mm.

Plastics bottles can be blow-moulded to have thin side walls but clearly the stiffness of the side walls of the bottle is thereby reduced. There is a risk that the filled bottles will bulge or sag when stored, particularly in warm temperatures and problems can also arise on the filling lines if there is any kind of interruption to the passage of the bottles therethrough and a row of bottles becomes pushed together in a queue compressing the bottles at the head of the queue. If the bottles are to be enclosed in e.g. a plastics stretch film sleeve, the bottle must also resist any compression forces exerted by the sleeve significantly distorting the bottle, and finally the bottle must be sufficiently rigid for the user to be able to comfortably handle the bottle without compressing it unduly, particularly after the bottle has been opened since any compression of a filled bottle can readily lead to accidental discharge of some of the contents.

It has been previously proposed in DE-A-1432253 to provide a one-trip plastics bottle having a substantially constant wall thickness and a body portion at least a part of which is provided with a plurality of depressed zones arranged in a series of horizontal rows. As illustrated in this disclosure the depressed zones are of diamond shape having a long dimension disposed vertically with the depressed zones in each row being vertically aligned and meeting one another. Bulging of the side walls is not a problem since the body is cylindrical. The orientation of the diamond shape depressed zones with their long dimensions vertical is in the direction to improve compression or top load strength of the bottle but as shown horizontal lines of weakness exist in the planes passing through the points where the depressed zones of one horizontal row approach the depressed zones of adjacent rows.

According to the present invention there is provided a lightweight plastics bottle having a body wall of substantially constant wall thickness and having a plurality of depressed zones having a floor portion spaced inwardly of and parallel to the general plane of the body wall, said depressed zones being arranged in a series of horizontal rows characterised in that the body is non-cylindrical having a number of body panels and that each of said depressed zones has at least one long dimension lying in a direction which is not parallel to the longitudinal axis of the bottle. The stiffness of the body panels is increased primarily about axes which lie at right angles to the long dimensions of the depressed zones.

Preferably the depressed zones have at least one long dimension lying normal to the longitudal axis of the bottle so that the stiffness of the body panels about a vertical axis, i.e. to provide bulge resistance, is at least as great as the stiffness of the body panels about a horizontal axis, i.e. in the direction which contributes to the top load strength of the bottle.

The side walls of the depressed zones which connect the floor portion thereof to the body wall are preferably inclined to the plane of the body wall.

The depressed zones can be arranged as discrete zones separated from each other by areas in the general plane of the body wall, alternate rows of depressed zones being arranged in alternate columns, the distance between alternate rows and alternate columns being less than the maximum dimension of the depressed zones in the direction of the spacing of the rows and columns respectively.

In an alternative arrangement the depressed zones of each row are arranged in vertically aligned columns, the depressed zones having a shape to adjoin adjacent depressed zones in each row and column with the inclined side edges meeting at junctions in a plane other than the plane of the floor portion or the plane of the wall and the junctions of each column and row being separated from one another by body portions in one of said floor or wall planes.

Secondary depressions can be formed at the junctions between at least some of the depressed zones, said secondary depressions having floor portions spaced inwardly of the floor portions of the depressed zones and having inclined edges merging with the inclined edges of the depressed zones and connecting with the body wall. This ensures that the stiffness of the body about axes passing through the secondary depression is maximised.

The depressed zones can be of any convenient shape such as round, oval or polygonal but when the depressed zones of each row are arranged in vertical columns the depressed zones preferably have a polygonal shape such that the corners of the polygons meet one another.

The floor portions of the depressed zones are preferably spaced from the plane of the body wall by between one and eight times the thickness of the wall. The wall thickness is preferably between 0.2 mm and 0.5 mm, the long dimension of the depressed zone being between 3 mm and 8 mm. The depressed zones should not be too deep in relation to their size since stresses may be formed in the material in the blow-moulding process. Small and deep depressed zones are also likely to lead to undue thinning of the material in the blow-moulding.

The invention will now be more particularly described with reference to the accompanying diagrammatic drawings in which FIG. 1 is a perspective view of a lightweight plastic bottle according to one embodiment of the invention;

Figure 1:
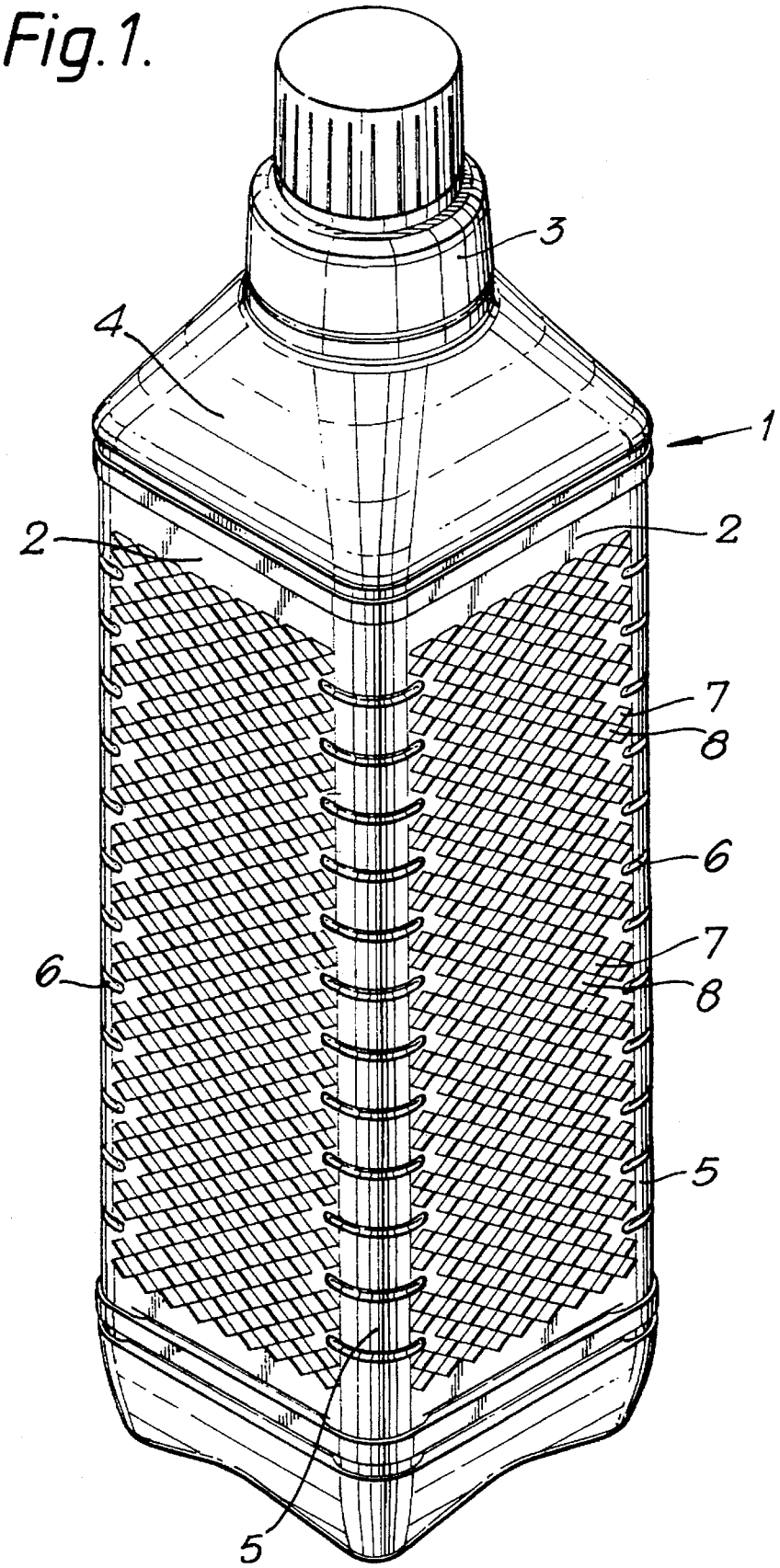

Referring to FIG. 1 there is shown a lightweight plastics bottle 1 having four side walls 2. The top of the bottle has a neck closed by a closure cap 3, the neck being connected to the side walls by a shoulder 4.

As seen from above the side walls 2 are joined by radiused corners 5 and to provide rigidity to these corners arcuate grooves 6 are formed at intervals therein.

To stiffen the side walls 2 and minimise bulging i.e. minimising any tendency of the bottle to tend towards a circular cross-section, each of the side walls is provided with a series of depressed spacing zones 7 spaced from one another by similarly shaped zones 8 lying in the normal plane of the side wall 2.

Figure 2:
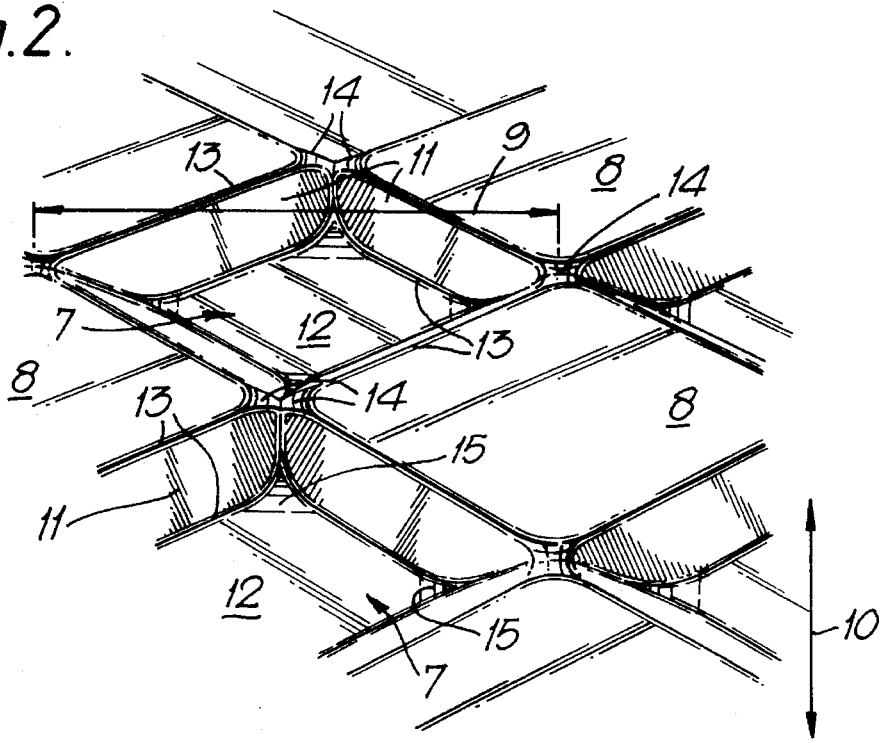
FIG. 2 is a view of an enlarged scale of a part of the wall of the bottle in FIG. 1.
Figure 3:
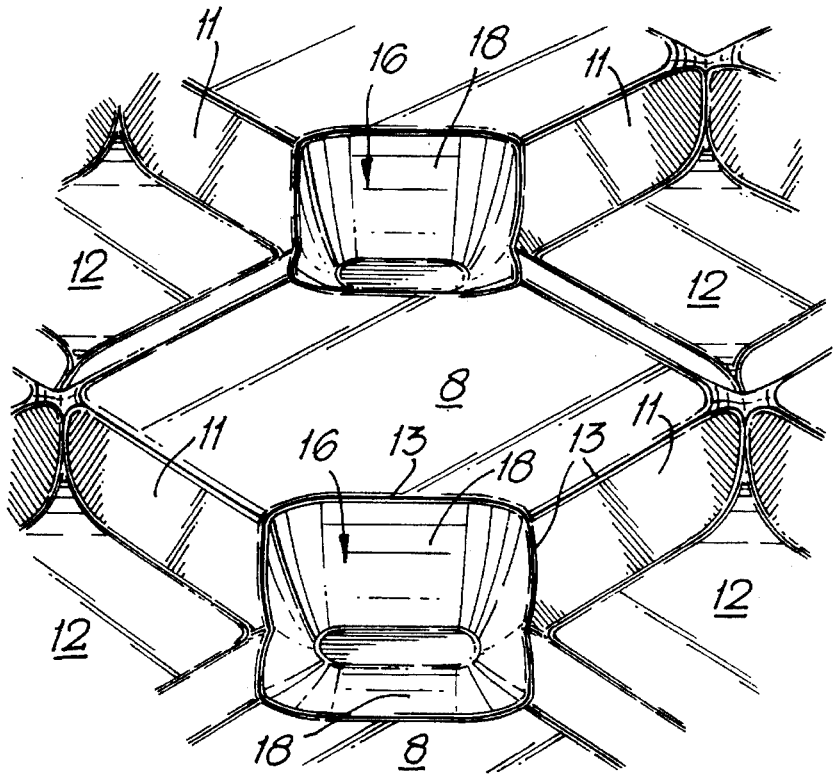
FIG. 3 is a perspective view of an enlarged scale similar to FIG. 2 showing an alternative embodiment of the invention.
Figure 4:
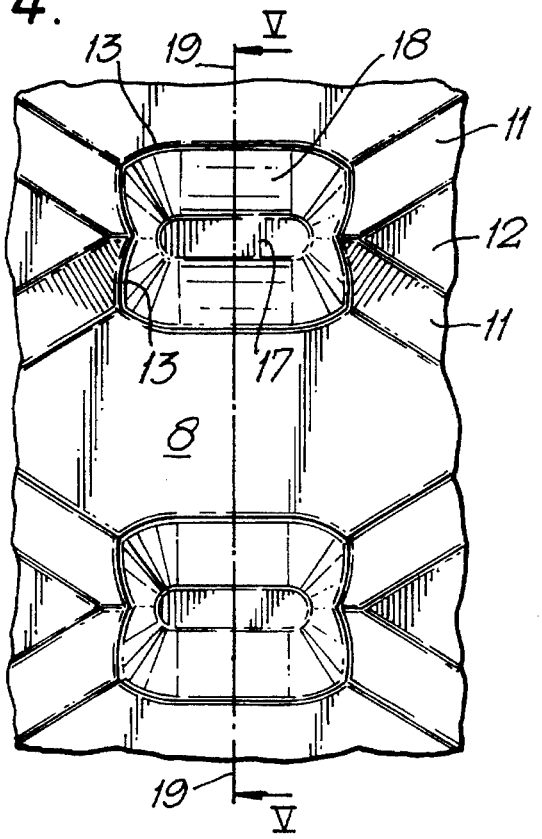
FIGS. 4 and 5 are plan an cross-sectional views respectively of the embodiment of FIG. 3.

As shown more clearly in the enlarged perspective view of FIG. 2 the depressed zones 7 have a rhombus shape with the long dimensions 9 extending at right angles to the vertical axis 10 of the bottle. The edges 11 of the depressed zones are inclined outwardly from a floor portion 12 and are joined with the floor portions and the normal plane of the side wall by a small radii 13.

The depressed zones of each horizontal row are arranged in vertically aligned columns.

The polygonal form of the depressed zones is such that the inclined edges of the depressed zone meets with the edges of adjacent depressed zones in adjacent columns and rows. More particularly, because of the radii 13 the intersections are formed at a plane intermediate the planes of the floor portions and the normal plane of the side wall. Thus the normal plane of the side wall between adjacent spacing zones 8 is curved downwardly at 14 and the floor portions curve upwardly at 15 at the intersections. It is thereby ensured that there are no continuous straight lines extending across the side wall in any direction which are not interrupted by a change in the plane of the material. The depressed zones thus provide a stiffening of the side wall in all directions.

Because the long dimension 9 of the depressions is normal to the longitudinal axis 10 of the bottle the stiffening effect of the series of depressed zones 7 is more effective to stiffen the body wall against bending about the direction of the axis 10 than against bending about axes in the direction of the long dimension 9. The depressed zones are therefore particularly effective in stiffening the body wall against bulge tending to cause the cross-sectional shape of the bottle to become circular.

Figure 5:
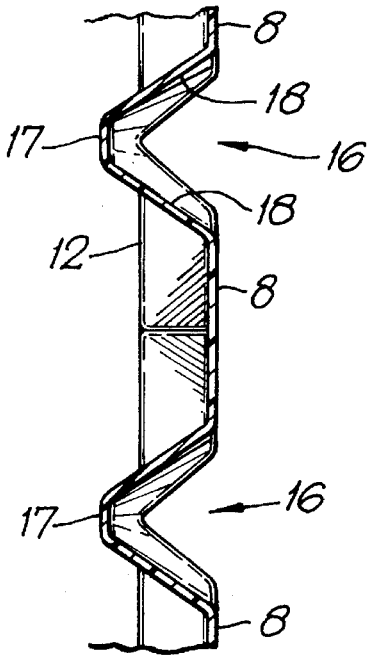

In order to further strengthen the body panel at the junctions between the spacing zones 8 secondary depressions 16 can be provided at this location as shown in FIGS. 3 to 6. These secondary depressions 16 have floor portions 17 which as seen in FIG. 5 are spaced inwardly of the floor portion 12 of the depressed zones. The depressions have inclined edges 18 which merge with the spacing zones 8 and the inclined edges 11 of the depressed zones with small radii 13.

It will be understood that these depressions 16 are particularly effective in stiffening the side wall against bending along planes 19—19, i.e. in resisting bulging by bending along these planes.

Figure 6:
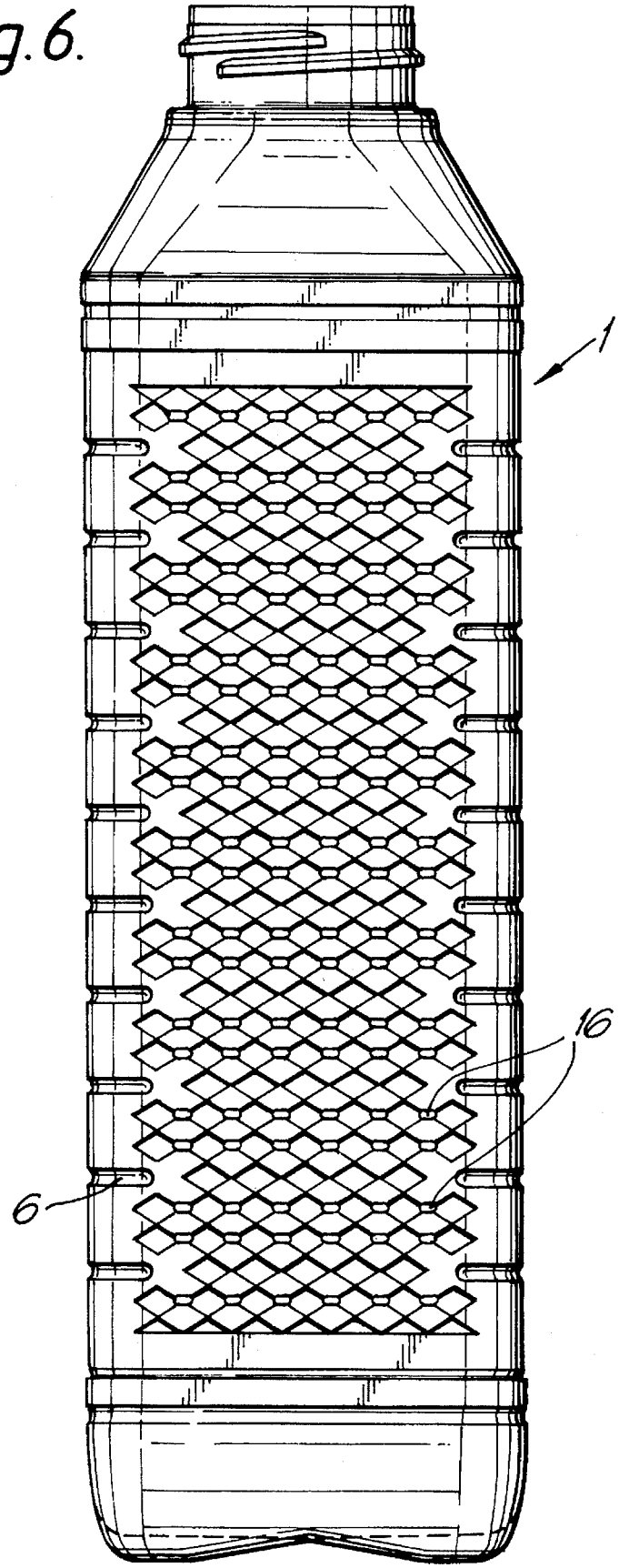
FIG. 6 is a side elevation of a bottle according to the embodiment of FIGS. 3 to 5.

The depressions 16 can however lead to a reduction of the stiffening effect of the depressed zones against bending in the horizontal planes passing through the depressions in a single row. As shown in FIG. 6 the depressions 16 are therefore not provided in rows aligned with the recesses 6 in the corners of the bottle since the presence of the recesses 6 aligned with the depressions 16 can lead to undue reduction in the top load strength of the bottle.

Figure 7:
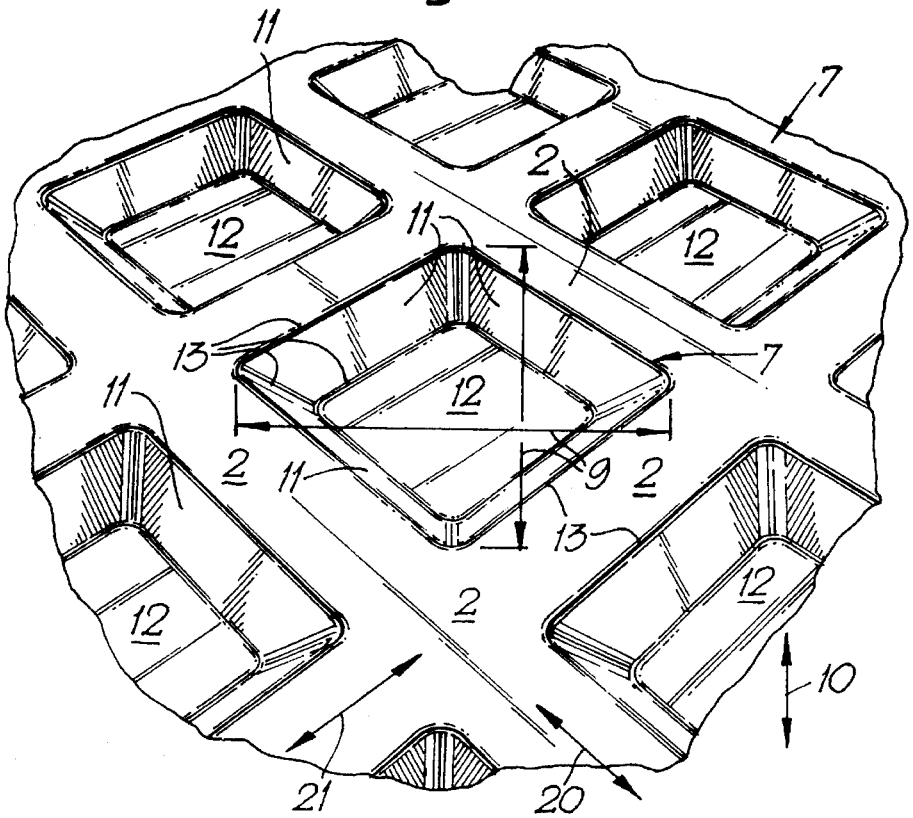
FIGS. 7 and 8 are perspective views on an enlarged scale similar to FIGS. 2 and 3 showing further embodiments of the invention.

Referring now to FIG. 7, there is shown as alternative arrangement of depressed zones 7 in which the depressed zones are again arranged in horizontal rows but in which depressed zones in alternate rows are arranged in alternate columns with the distance between alternate rows and alternate columns being less than the maximum dimensions of the depressed zones in the direction of the spacing of the rows and columns respectively.

As shown in FIG. 7 the depressed zones are each a square, arranged to have a long dimension 9 aligned with the longitudinal axis 10 of the bottle and an identical long dimension 9 at right angles thereto. The spacing between adjacent rows is less than the dimension 9 and the spacing between adjacent columns is also less than the dimension 9. The depressed zones of adjacent rows are thus nested between one another but each of the depressed zones are discrete and separated from one another by areas 2 in the normal plane of the side wall.

As before each depressed zone 7 has a floor portion 12 and inclined edges 11 joining the floor portion 12 to the areas 2 of the side wall, all the intersections of the edges with each other and with the floor portions and the side wall areas 2 being formed with small radii 13.

It will be apparent that the nesting of the rows and columns of depressed zones ensures that all planes of the wall in the direction of the longitudal axis 10 of the bottle, and all planes at right angles thereto, are interrupted by depressed zones which stiffen the side wall against bending about axes in these directions. Nevertheless it will be apparent that the side wall is not stiffened against bending along a line such as shown at 20 and 21 in FIG. 7. The side wall is nevertheless considerably stiffened against bulging and in respect of top loading.

Figure 8:
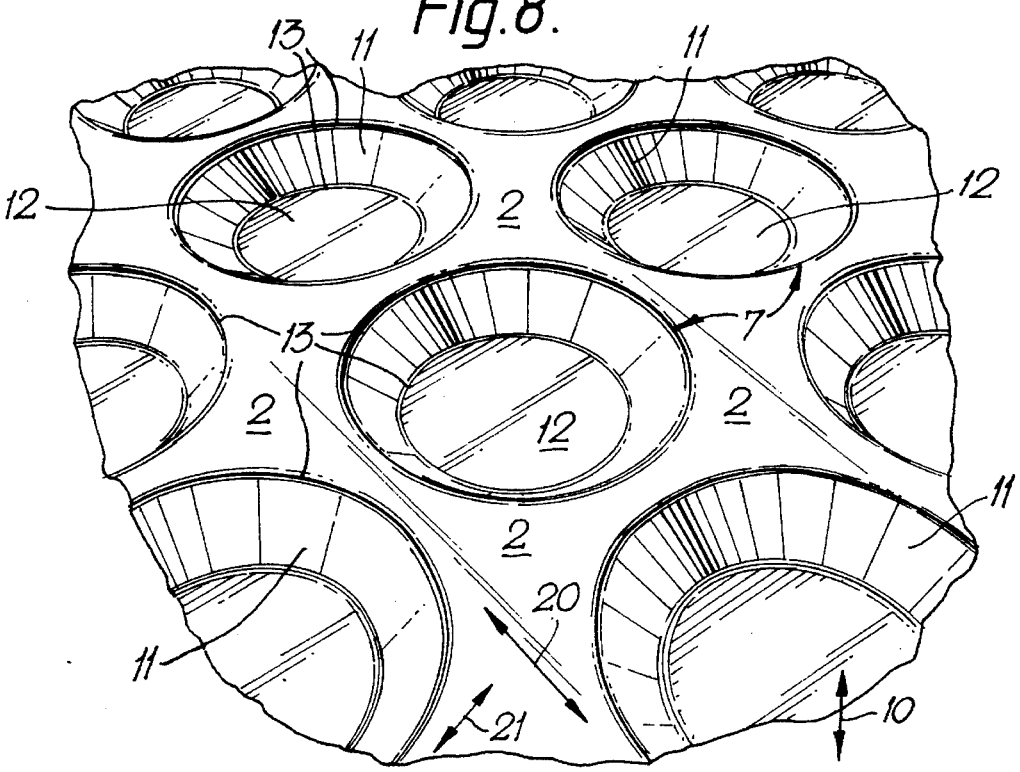

The depressed zones can be of any convenient shape and in the arrangement of FIG. 8 the depressed zones 7 are circular. As before the depressed zones have a floor portion 12 and inclined edges 11, the edges joining the floor portion 12 and side wall areas 2 with small radii 13. Whilst this arrangement considerably stiffens the side wall in respect of bulge and top load strength it allows bending along lines 20 and 21 as in the arrangement of FIG. 7.

Bottles according to each of the embodiments described above can be made by blow-moulding of a plastics material such as high density polyethylene to have a substantially constant wall thickness in the range of 0.2 to 0.6 mm, such bottles being generally known as lightweight bottles. Such bottles having flat side walls are relatively flexible and can readily be deformed out of their predetermined shape. By providing depressed zones as described the stiffness of the side walls has been found to be considerably increased and problems arising from bulging of the walls, or compression of the walls during handling of the bottles both mechanically and by the user have been minimised.

The stiffening effect of the depressed zones is obviously dependant upon the depth of the depressed zones and it has been found that this depth should be between one and eight times the thickness of the wall. The depth of the depressed zones is also governed by the size of the depressed zones since otherwise the blow-moulding can lead to undue thinning of the plastics material. Preferably the depressed zones should have a long dimension of between 3 mm and 12 mm, particularly between 5 mm and 9 mm. Lightweight bottles according to the invention can be provided with a plastics film sleeve for decoration and labelling, the plastics film being stretched to apply to the bottle and subsequently allowed to shrink back to conform the bottle side walls without causing the side walls to bend inwards. Gaps between the plastics sleeve and the bottle side walls are therefore avoided.

I claim:

1. A lightweight plastics bottle having a body wall of substantially constant wall thickness and having a plurality of depressed zones each having a floor portion spaced inwardly of and parallel to the general plane of the body wall, said depressed zones being arranged in a series of horizontal rows, wherein:

the body is non-circular and has a number of body panels and each of said depressed zones has at least one long dimension lying in a direction at right angles to the longitudinal axis of the bottle;

the depressed zones are connected to the body wall by side edges which are inclined to the plane of the wall; and the depressed zones of each row are in vertically aligned columns, the depressed zones each having a shape to adjoin adjacent depressed zones in each row and column, with the inclined side edges meeting at junctions in a plane other than the plane of the floor portion or the plane of the wall and the junctions of adjacent columns and rows being separated from one another by portions in one of said floor or wall planes.

2. A bottle according to claim 1 characterised in that secondary depressions are formed at the junctions between at least some of the depressed zones, said secondary depressions having floor portions spaced inwardly of the floor portions of the depressed zones and having inclined edges merging with the inclined edges of the depressed zones and connecting with the body wall.

3. A bottle according to claim 1 characterised in that the floor portions of the depressed zones are spaced from the plane of the wall by between one and eight times the thickness of the wall.

4. A bottle according to claim 1 characterised in that the wall thickness is between 0.2 mm and 0.5 mm, the long dimension of the depressed zones being between 3 mm and 12 mm.

5. A lightweight plastics bottle having a body wall of substantially constant wall thickness and having a plurality of depressed zones each having a floor portion spaced inwardly of and parallel to the general plane of the body wall, said depressed zones being arranged in a series of horizontal rows, wherein:

the body is non-circular and has a number of body panels and each of said depressed zones has at least one long dimension lying in a direction at right angles to the longitudinal axis of the bottle;

the depressed zones are connected to the body wall by side edges which are inclined to the plane of the wall;

the depressed zones are arranged as discrete zones separated from one another by areas in the plane of the body wall; and the depressed zones of alternate rows are first in vertically aligned columns and the depressed zones of rows intermediate said alternate rows being disposed in second vertically aligned columns, the distance between adjacent rows being less than the maximum dimension of the depressed zones in the direction of the spacing of the rows and the distance between adjacent columns being less than the maximum dimension of the depressed zones in the direction of the spacing of the columns.

* * * * *